United States Patent [19]

Lederrey

[11] Patent Number: 4,561,783

[45] Date of Patent: Dec. 31, 1985

[54] WATCHCASE

[75] Inventor: Marc Lederrey, Le Landeron, Switzerland

[73] Assignee: Montes Rado S.A., Biel, Switzerland

[21] Appl. No.: 717,464

[22] Filed: Mar. 27, 1985

Related U.S. Application Data

[63] Continuation of Ser. No. 267,692, May 27, 1981, abandoned.

[30] Foreign Application Priority Data

May 31, 1980 [CH] Switzerland ..... 4228/80

[51] Int. Cl.[4] ..... G04B 37/00

[52] U.S. Cl. ..... 368/309; 368/294; 368/296; 268/291

[58] Field of Search ..... 368/276, 294, 295, 296, 368/309, 223, 285, 286, 287, 291, 292

[56] References Cited

U.S. PATENT DOCUMENTS

| | | | |
|---|---|---|---|
| 1,239,467 | 9/1917 | Depollier | 368/294 |
| 3,495,398 | 2/1970 | Widmer et al. | 368/296 X |
| 4,241,442 | 12/1980 | Grohoski | 368/294 |
| 4,327,429 | 4/1982 | Klingenberg | 368/294 |

FOREIGN PATENT DOCUMENTS

| | | | |
|---|---|---|---|
| 2077642 | 2/1970 | France . | |
| 2397668 | 9/1979 | France . | |
| 257783 | 2/1946 | Switzerland . | |
| 259740 | 6/1949 | Switzerland | 368/296 |
| 323978 | 8/1957 | Switzerland . | |
| 335158 | 2/1959 | Switzerland | 368/296 |
| 336334 | 3/1959 | Switzerland . | |
| 435123 | 9/1966 | Switzerland . | |
| 336334 | 3/1969 | Switzerland . | |

*Primary Examiner*—Bernard Roskoski

*Attorney, Agent, or Firm*—Parkhurst & Oliff

[57] ABSTRACT

The watchcase has the upper face of its caseband wholly covered by the glass composed of: an outer plate of transparent material; a smaller transparent plate centrally glued to the inner face of the outer plate for securing the glass to the caseband by its insertion in the caseband opening, and an ornamental opaque fitting in the form of a frame also glued to the outer plate, radially some distance apart from the smaller transparent plate. This fitting may consist either wholly of a transparent body opacified by a vaporized layer or partly of a transparent body, under which a precious or semi-precious stone is glued, or of a metallic or ceramic body. Like a bezel, it determines the aspect of the visible watchcase face while the watch is worn.

Every piece of a series of identical watchcases can be given an original appearance simply by gluing a particular fitting to the glass.

12 Claims, 6 Drawing Figures

WATCHCASE

This is a continuation of application Ser. No. 267,692, filed May 27, 1981, now abandoned.

BACKGROUND AND SUMMARY OF THE INVENTION

This invention relates to watchcases, particularly to those watchcases in which the periphery of the glass wholly covers the caseband and appears around a transparent glass part in lieu of the bezel of conventional watchcases.

With the known watchcases of this type, the glass periphery is given the appearance of a bezel by depositing a thin layer of metallization either over a glass flange or on the walls of a groove provided in the lower face of said flange (Swiss Patent CH-B-336,334).

While the metallization formed over the outer glass face, being exposed to wear in contact with foreign bodies, is not very durable, that deposited on the walls of a groove formed in the lower face of the glass flange offers only a narrow range of ornamental possibilities. Firstly, that known solution does not provide a tight seal between the glass and the caseband. Moreover, it is applicable only to circular glasses, because of the mode of fixation of the glass. It is also limited to glasses made out of a relatively soft material, because of the shape which the glass is to be given. A hard glass, such as a sapphire or a tempered mineral glass, as commonly used nowadays with highgrade watches, can, indeed, not be given that shape. Finally, the metallization disclosed by that known solution may only produce surfaces with plain colors having a metallic glance.

Thus, it appears that this known solution is suitable only for very indifferent watchcases which are manufactured in large series of identical pieces. Now, with high-grade watches, a large number of one and the same watchcase pattern is seldom ordered. Therefore, the manufacturers of the casings for such watches are reduced to small-scale thus expensive production. If they have to manufacture different watchcase designs for watches of the same shape, sizes and caliber, they must have many skilled workmen at disposal as well as an important mechanical equipment to carry out at the same time the finishing operations for every watchcase pattern ordered in order to be able to deliver these watchcases at once and not in driblets.

However, it is known to provide the glass periphery with decorative motifs breaking the monotony of extensive plain surfaces by forming reflecting facets on the lower glass face (Swiss Patent CH-B-435,123). This solution does, however, not confer on the glass periphery the appearance of a framing taking the place of the bezel of the conventional watches. It aims, on the contrary, to give one illusion that the dial extends near to the watchcase edge, where a metallic watchcase part, necessary to the protection of the glass, still subsists, and which, though it is very narrow, nevertheless appears as a bezel that must be finished as such, but in a very restricted range of possible aesthetical effects. Furthermore, this solution is, like the first one referred to hereabove and for the same reasons, confined to glasses made out of a relatively soft material.

Watchcases are also known in the art, the bezel of which, made in two pieces, consists of a unit separate from the glass and the caseband, and comprises a ring of transparent material provided on its lower face with horal divisions molded in sunk relief and filled with a clear phosphorescent material in order to contrast with a dark protecting varnish applied on the lower side of said ring, thus constituting an annular dial of the watch (Swiss Patent CH-A-323,976).

In comparison to the two known inventive watchcases considered hereabove, it is not the glass itself in this third known watchcase which comprises an opaque area at its periphery, but a piece which is independent thereof and which is mounted per se on the watchcase. Moreover, the glass can only be made out of a relatively soft material.

In the prior art there are still watchases in which the glass and the caseband, made out of hard materials having almost the same coefficient of thermal expansion, form a single piece when assembling the watch by mounting the movement in the watchcase (French Patent FR-A-2,397,668).

The manufacture of the whole caseband out of a material almost as hard as the sapphire of the glass however constitutes an operation which is as delicate as it is hard and consequently slow and very expensive.

The watchcase according to the invention avoids the drawbacks above-mentioned while substantially broadening the range of appearances which the watchcase can be given. With the exception of the functional organs of the watch (dial, horal divisions, windows, hands, calendar rings) it is, as a matter of fact, the watchcase part usually occupied by independent conventional bezels which essentially determines the aspect of a wrist-watch while being worn. To make a piece of jewelry out of a wrist-watch, as is proper with a high-range watch, it is accordingly on that watchcase part that one has to work, and that, by providing at that place ornamental elements other than a functional dial.

With the inventive watchcase structure the support of those ornamental elements is the fitting fixed to the plate of transparent material of the glass. It means that with a watchcase having a predetermined shape and given sizes for receiving a predetermined watch movement type, the caseband, the bottom and the plate of transparent material of the glass can be manufactured in mass production, however great the number of the different required finishings of the visible watchcase face may be. It is, indeed, the fitting fixed to the plate of transparent material of the glass, which constitutes the visible watchcase face and confers on the watchcase its aspect. Moreover, that fitting is easy to be manufactured because of its simple geometrical shape.

The particular structure of the watchcase according to the present invention has the advantage that the watchcases of a given series all have the same height, whatever fitting is fixed to the plate of transparent material of the glass. With such watchcases, the free space between the dial and the glass always has the same height for the accommodation of the hands. Moreover, the projection formed under the glass periphery by the fitting, like the separate bezel of the conventional watchcases, offers ample space for massive ornamental elements. Preferred embodiments of the present invention relate to structures embodying two equally advantageous modes of fixing the fitting to the glass plate of transparent material. The glues available on the market enable performing durable adherences, which are amply sufficient in this instance. They are, moreover, perfectly transparent and, under certain easily realizable conditions, they quickly dry.

The protecting effect exerted by the glass in the preferred embodiments has already been used abundantly in the field of watchcase manufacturing. In this instance, it permits decorating the visible part of the watchcase by means of ornamental elements even very delicate, without exposing them to alteration, since they lie under the protection of an essentially hard element.

The ornamental elements of the glass may also consist of thin layers formed by vaporization in the vacuum. However, the fitting fixed to the glass plate of transparent material permits to make them massive. They can even constitute the whole glass periphery. With a glass of synthesized corundum, the ornamental elements are preferably made of colored corundum.

The structure ensures a standard fixing mode of the glass to the caseband by particularly simple means.

Due to its periphery perfectly laid on the caseband, the glass has the advantage of being well protected against shocks and the risk of being caught by foreign bodies.

BRIEF DESCRIPTION OF THE DRAWINGS

Some embodiments of the watchcase according to the invention will now be described by way of example and with reference to the accompanying drawings in which.

DETAILED DESCRIPTION OF THE PREFERRED EMBODIMENT

Figure 1:
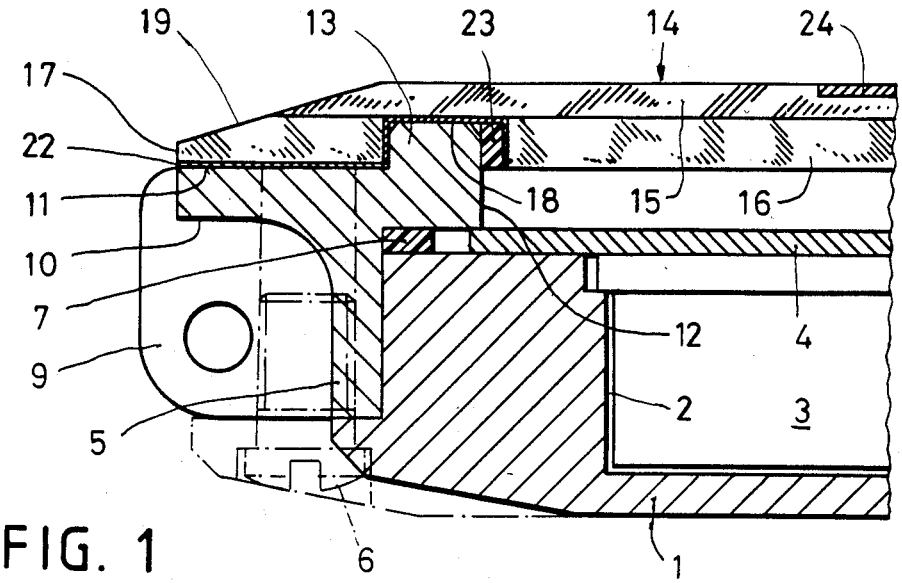
FIG. 1 is a part radial cross-section of a first embodiment.
Figure 2:
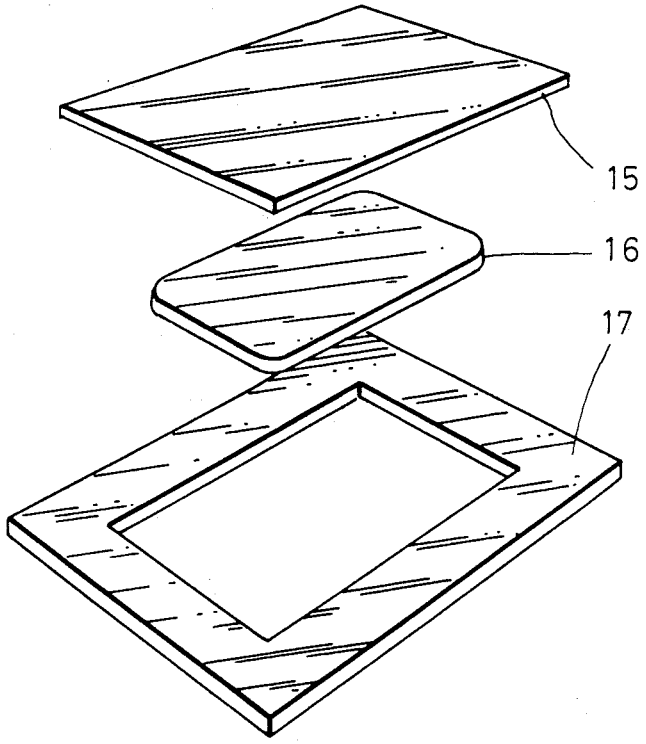
FIG. 2 is an exploded perspective view of a blank of the glass of FIG. 1.
Figure 3A:
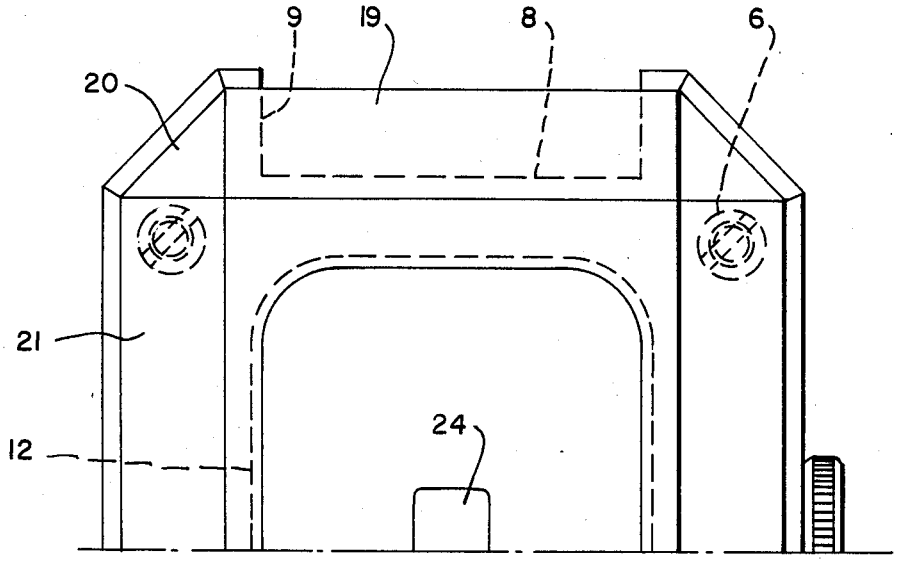
FIG. 3*a* is a plan view of the watchcase illustrated in FIG. 1

The watchcase represented in FIGS. 1, 2 and in FIG. 3*a* has a generally rectangular shape. It comprises a first metallic piece 1 including the bottom and having the same shape. A circular cylindrical recess 2 for the watch movement 3 is provided in piece 1. The dial 4 too has a rectangular shape, but its edges are rounded off. Piece 1 together with the movement 3 and the dial 4 is set in a caseband 6 constituting a second metallic watchcase piece and to which piece 1 is secured by means of screws 6, as shown in FIG. 1 in dot-and-dash lines representing a cross-section of the watchcase turned around the axis of the latter. The tightness of the gap between these two metallic pieces of the watchcase is ensured by means of a packing 7. Opposite six and twelve 0'clock cutouts 8 (FIG. 3*a*) are provided in caseband 5 in order to form horns 9 under a web 10 for the attachment of a wrist-band by means of spring lugs as well known to those skilled in the art. The caseband 5 has a flat upper face 11 and, along the edge of the central opening 12, a projection 13. The contour of opening 12 is similar to those of the watchcase and of the dial, as shown in FIG. 3.

The glass 14 of the watchcase according to the invention is composed of three pieces of transparent synthesized corundum, commonly called sapphire, the faces of which are polished. FIG. 2 shows a blank of that glass comprising a rectangular upper plate 15, a central plate 16, which is smaller, and the shape of which exactly corresponds to that of opening 12 of caseband 5, and a frame 17 having the same thickness as the central plate 16. The outer sizes of frame 17 can either be equal or larger than those of the upper plate 15. The frame opening is larger than the central plate 16. Pieces 16 and 17 are separately glued to the lower face of the upper plate 15 by means of a glue which does not spoil the transparency of the corundum.

When the three pieces 15, 16, 17 are joined together, a groove 18 appears on the lower side of the glass 14, between the central plate 16 and the frame 17. The upper edge of the glass 14 is chamfered as shown at 19, 20, 21 (FIG. 3*a*). These chamfers extend over the whole height of the upper plate 15 and a part of frame 17 FIG. 1). The lower face of plate 16 is then masked and a layer 22 of some hundreds of angstrom units is deposited on the walls and the bottom of groove 18 as well as under frame 17 by vaporization in the vacuum so as to opacify these parts of glass 14. Since the faces of glass 14 metalized in that way are polished, the layer 22 appears bright through the glass. In the embodiment disclosed, it is layer 22 which will confer on the part of the watchcase face surrounding the transparent central area of glass 14 its definitive aspect. The glass 14 is indeed set in place by introducing its central part 16, encompassed by a plastic sleeve 23, with force fit into opening 12 of caseband 5 until the bottom of groove 18 and frame 17 lie on projection 13 and face 11, respectively, of caseband 5. To avoid, on the other hand, a strain in the part of the upper plate 15 of glass 14 which extends between the central plate 16 and the frame 17, after having set the glass in place, and on the other hand, a visible gap between frame 17 and caseband 5, the height of projection 13 is made exactly equal to the thickness both of the central plate 16 and of the frame 17. Since the glass extends outwards up to the outer edge of caseband 5, the upper face 11 of the latter is completely hidden by layer 22, as it is hidden too by the metallic bezel mounted on the caseband with conventional watchcases.

Besides silver and gold there are many other materials suitable to confer an aesthetic aspect on the watchcase among those which can be vaporized in the vacuum. Chromium, titanium and even carburized or nitridized compounds are cited merely by way of example. By judiciously determining the thickness of layer 22, it is possible to obtain an original display of iridescent colors. It is also possible to produce a contrast between the bottom of groove 18 and frame 17 by metalizing, firstly, the groove 18 alone, both the frame 17 and the central plate 16 being masked, and by metalizing afterwards the uncovered frame 17. If a titanium carbide layer has, for instance, been deposited under frame 17, a titanium carbide plate 24, having a shape similar to the visible dial part, can be glued in the center of glass 14 in a recess of the outer face of the upper plate 15. While matching with the glass periphery, such a plate has the advantage to hide the axis of the hands as well as their crossing near the center of the watch.

It will appear from the preceding description that while manufacturing the two metallic watchcase pieces 1 and 5 as well as the blank of the glass 14 in large series, it is nevertheless possible to confer quite different aspects on the watchcase, because these aspects are exclusively determined by the vaporizations made in a last step on the glass periphery. Although the metalization is formed on flat faces, it acquires relief because of chamfers 19, 20, 21 and of the coefficient of refraction of the sapphire. Moreover, frame 17 produces an original depth effect. The optical properties of the glass disclosed still cause the watchcase to appear very thin when viewing it in a direction perpendicular to its axis.

It should be observed that the adherence of the vaporized layers on the corundum is not at all critical, because the glass prevents them from contacts with foreign bodies. To prevent these metalizations from chemical corrosion, a protecting layer can be deposited on them.

Figure 3B:
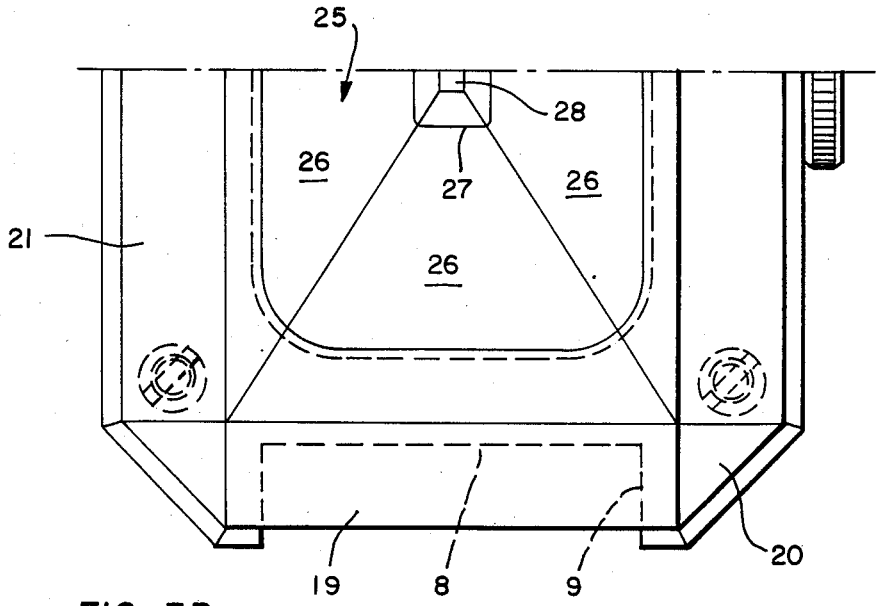
FIG. 3*b* is a plan view of another embodiment of the watchcase in accordance with the invention.

In the second embodiment represented in lower half of FIG. 3, the central area of the upper face of the glass 25 is not flat. Facets 26 in the form of a frustum of a tetragonal pyramide have been cut on that part of glass 25. If a plate 27 is located in a recess of the glass like in the first embodiment, the facets 26 can extend either up to the edge of that plate or on a part thereof, the pyramid being truncated in the middle portion of plate 27, as shown at 28 in FIG. 3*b*.

Figure 4:
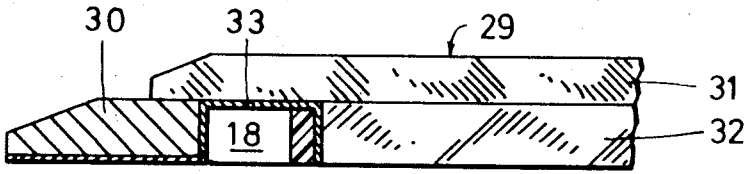
FIG. 4 is a partial section of the glass of still another embodiment.

FIG. 4 shows a third embodiment of the watchcase according to the invention. In this embodiment, which differs from the preceding ones only by the glass, the glass 29 is no longer fitted with a transparent frame, but with opaque elements 30. Two first opaque elements 30 can thus be glad glued under the upper plate 31 of glass 29, along the sides thereof opposite three and nine o'-clock. Two further opaque elements either made out of the same material as the two first elements 30 or of a different material can then be glued between the ends of the two first opaque elements, along the short glass sides. The elements 30 can be metallic or ceramic; they can even consist of synthesized colored corundum. A transparent plate 32 is also glued under the central area of plate 31 and an opaque layer 33 is vaporized into groove 18 of glass 29. This layer may extend under elements 30, where it has, however, no effect unless the elements 30 are somewhat translucent.

In another embodiment (not shown) the transparent glass part could extend only up to the groove formed under the glass. Metallic, ceramic opaque elements (even of colored corundum) would then be glued, not under the transparent glass plate, but against its edges. Chamfers, like 19, 20, 21, cut along the glass edges, would then preferably start from the joint between the transparent and opaque glass parts. That joint would then no longer appear in the middle of a facet, as in the first embodiment, but along the intersection line between two flat surfaces where it would be substantially less apparent, more essentially as there is a contrast between the metalization of the groove and the elements glued against the transparent glass plate. With respect to the embodiments previously disclosed, in which the glass is composed of elements glued on one another, the last mentioned embodiment has the advantage that it offers a constant well-determined gluing surface between the opaque elements and the transparent glass plate, whichever inclination the chamfers at the glass periphery may have.

Figure 5:
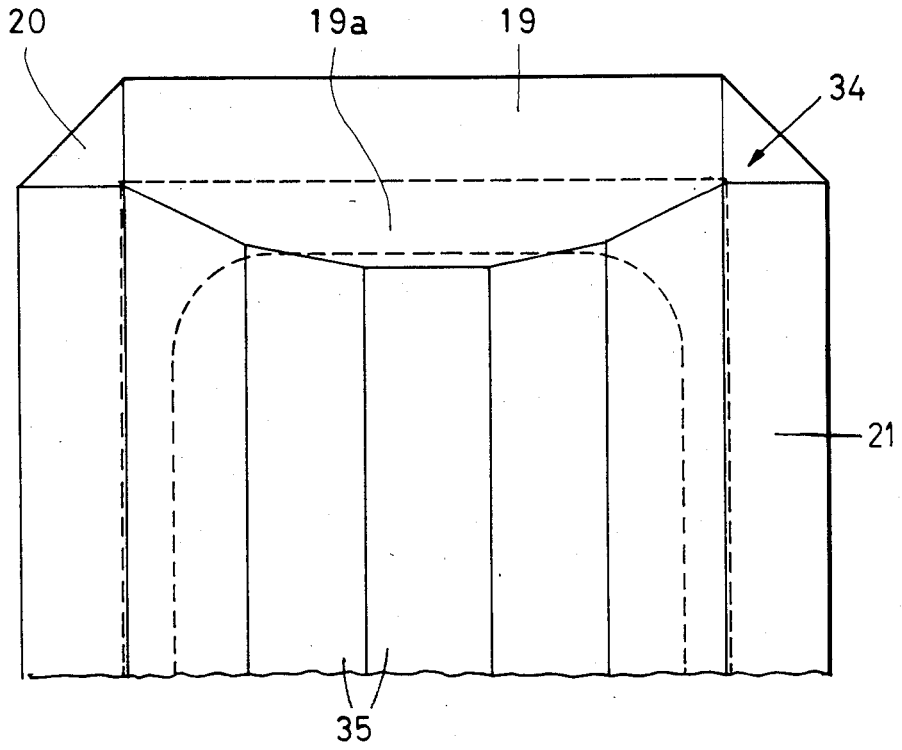
FIG. 5 is a partial plan view of a last embodiment.

FIG. 5 shows an embodiment which differs from the preceding ones only by the form of the glass outer surface. Instead of being cut in the form of a pyramid frustum, the area of the outer surface of the glass 34, which extends between the chamfers 19, 20, 21, is formed with facets 35 which are parallel to the direction six - twelve o'clock. In this case the two chamfers 19 on the small sides of the watchcase extend in 19*a* in a part of the central glass area.

In still further embodiments (not shown), the ornamental elements carried by the frame fixed to the glass plate of transparent material, consists of precious or semi-precious stones as for instance lapis lazuli, tiger-eye, opal, coral, malachite, etc. For this purpose, the transparent frame 17 of the first embodiment (FIG. 1) is made thinner than the central glass plate 16 and a precious or semi-precious stone frame is glued under said transparent glass frame. The total thickness of the transparent frame and the stone is thereby equal to the thickness of the central transparent plate of the glass.

In this last embodiment, the central stone part cutout from the frame fitting the glass is not lost; it can be set on the dial. The dial and the watchcase thus have the same veins and the same colors, since the ornamental elements of the dial and of the watchcase come from the same stone. Moreover, the stone fitting the glass is not only protected, its visible face has more glance, is brighter than that of an uncovered stone. Therefore, a stone plate, which should be provided in the center of the glass to mask the hands axis and their crossing, would be laid in a recess formed in the lower glass surface.

It should be observed that the metallic watchcase pieces and the glass have exactly the same shapes and the sames sizes in all the embodiments disclosed. Consequently, these metallic pieces and the glass blank can be manufactured in large series. Only the metalization of the glass groove and the fitting decorating the glass need be changed to produce quite different appearances of the watchcases finally delivered. As regards the metalizations, it suffices to expose the glass during the adequate time to the vaporation. The massive ornamental elements can be prepared while the other watchcase pieces are manufactured. Gluing these ornamental fittings to the glass plate of transparent material is an easy operation which does not extend the term of delivery unduly.

Although a glass of synthesized corundum has the advantage of constituting a shield rendering the visible watchcase face resistant to deterioration, it is obvious that the invention is not limited to such glasses. The whole glass or a part thereof could be made out of other materials such as a tempered mineral glass or even an organic material.

The list of embodiments disclosed is thus not exhaustive. The same series of metallic watchcase pieces and of glass blanks can result in a multitude of different appearances. By resorting to a glass blank of corundum, every ornament imagined, even the most delicate one, is resistant to deterioration. The watchcase designer is accordingly absolutely free in matching the ornaments of the dial and the watchcase according to its taste.

What is claimed is:

1. A watchcase comprising a metallic section, a caseband and a glass face, the metallic section having first and second sides and including means for accommodation of a watch movement and a watch dial, the watch dial being located on the first side of the metallic section, the caseband having a central opening therethrough for accommodation of the metallic section, the caseband surrounding a periphery of the metallic section and having top and bottom sides, the glass face extending over the whole face of the first side of said metallic section and the top surface of the caseband, the glass face extending to at least an outermost edge of the caseband and being removably secured to the top side of the caseband, said glass face comprising an external plate of transparent material and, permanently fixed thereto, a bezel-like fitting forming an opaque frame around said external plate so as to constitute the sole opaque watchcase part being visible around the watch dial.

2. A watchcase according to claim 1, wherein said fitting forms under the lower face of said external plate a fitting projection having a predetermined height.

3. A watchcase according to claim 2, wherein said fitting is glued onto said lower face of said external plate, at the periphery thereof.

4. A watchcase according to claim 1, wherein said glass face is synthesized corundum and provides a protecting shield of the watchcase.

5. A watchcase according to claim 3, wherein said top surface of said caseband has a plane upper face and a caseband projection projecting above said plane upper face and extending around the means for accommodation of a watch movement and watch dial, said glass face further comprising an internal transparent plate glued to the lower face of the external plate of transparent material some distance apart from said fitting to form a continuous groove between said internal transparent plate and said fitting, said groove being adapted to receive said caseband projection, said internal transparent plate entering the means for accommodation of a watch movement and watch dial so as to removably secure the glass face to the top surface of the caseband.

6. A watchcase according to claim 5, wherein the bottom of said groove and said fitting lie on said caseband projection and said plane upper face of the caseband, respectively, when the glass face has been set in place on the caseband.

7. A watchcase according to claim 1, wherein said fitting is metal.

8. A watchcase according to claim 1, wherein said fitting is ceramic.

9. A watchcase according to claim 1, wherein said fitting is stone.

10. A watchcase according to claim 9, wherein said stone is a precious stone.

11. A watchcase comprising:

a metallic section having a dial side and a bottom side, said metallic section including means for housing a watch movement and a watch dial;

a caseband having an central opening therethrough for accommodation of the metallic section, the caseband surrounding a periphery of the metallic section and having a top side and a bottom side; and a glass face extending over the entire dial side of the metallic section and the top side of the caseband, said glass face comprising an external plate of transparent material and a bezel-like fitting forming an opaque frame around the external plate, edges of the bezel-like fitting extending to at least an outermost edge of the caseband such that the caseband is not visible from the dial side of the watchcase.

12. The watchcase as recited in claim 11, wherein the glass face is removably secured to the caseband by a force fit between a projection on one of the glass face and caseband and a groove on the other of the glass face and caseband.

* * * * *